United States Patent [19]

Kolker

[11] 4,121,305

[45] Oct. 24, 1978

[54] PANTIES

[76] Inventor: Stephen D. Kolker, 124 E. 65th St., New York, N.Y. 10021

[21] Appl. No.: 770,356

[22] Filed: Feb. 22, 1977

[51] Int. Cl.[2] ..... A41B 9/04

[52] U.S. Cl. ..... 2/406

[58] Field of Search ..... 2/406; 128/289

[56] References Cited

U.S. PATENT DOCUMENTS

| | | | |
|---|---|---|---|
| 2,091,018 | 8/1937 | Sivyer | 2/406 |
| 2,206,412 | 7/1940 | Levy | 2/406 |
| 2,622,600 | 12/1952 | De Guyot et al. | 2/406 |
| 2,854,669 | 10/1958 | Cohen | 2/406 |

*Primary Examiner*—Doris L. Troutman

*Attorney, Agent, or Firm*—Sherman & Shalloway

[57] ABSTRACT

Panties include a semi-triangular crotch-piece which is supported on the wearer by elastic strings which fit over the pelvis. The panties are designed so as not to be visible through clothing.

10 Claims, 18 Drawing Figures

PANTIES

BACKGROUND OF THE INVENTION

The instant invention relates to garments, and more specifically, the instant invention relates to panties.

PRIOR ART

A primary difficulty with women's panties is that the outlines of the panties are visible through clothes. This is so because panties generally have elastic bands sewn around the waist and around the leg-holes. Even though the panties themselves, may be made of relatively light material, it is necessary that the elastic bands be relatively thick, in order to provide the proper biasing.

Generally, it is necessary to use elastic bands when defining openings through which a women's trunk and legs project, simply because women's bodies and apendages are of different sizes. Panties are made in different sizes, however, one size panty needs to be relatively flexible because that size must fit women of a wide range of sizes. For example, a size 5 panty must have sufficient adaptabiliy to fit women who have different size waists, thighs and buttocks. This flexibility or adaptability is achieved by using elastic bands.

When wearing relatively light clothing, or clothing which is somewhat translucent, the elastic bands on panties can be quite visible. This is especially so when wearing tight slacks. Since the elastic bands do not necessarily follow natural body lines, the appearance of the bands, through the slacks, can detract from the woman's appearance. For example, the elastic bands may not follow the crease between the woman's buttocks and thighs but rather extend either above or below the crease, which not only looks peculiar, but also calls attention to the woman's panties.

In addition, the elastic bands can, after a while, become uncomfortable and leave itchy, depressed lines in the skin.

In addition to the problems presented by elastic bands, the cloth structure of conventional panties is generally rather extensive. Consequently, the panties can be seen through sheer clothing. This is not always desirable. In addition, it is not desirable for the material in the rear to ride-up over the buttocks and bunch in the crease between buttocks.

In view of the foregoing difficulties with conventional panties, a new type of panty which avoids these difficulties is needed.

OBJECT OF THE INVENTION

It is an object of the instant invention to provide a new and improved panty.

It is a further object of the instant invention to provide a new and improved panty, wherein the panty does not utilize elastic bands which are readily visible through the clothing.

It is also an object of the instant invention, to provide a new and improved panty which is comfortable.

It is also an object of the instant invention to provide a new and improved panty wherein one size will fit a wide range of different sized women.

It is also an object of the instant invention to provide a new and improved panty wherein the cloth-part of the panty is not readily visible through the clothing.

It is also an object of the instant invention to provide a new and improved panty wherein the panty is simple to manufacture and relatively inexpensive.

It is also an object of the instant invention to obviate the riding-up and bunching of material in the crease between buttocks.

DETAILED DESCRIPTION OF THE INVENTION

Figure 1:
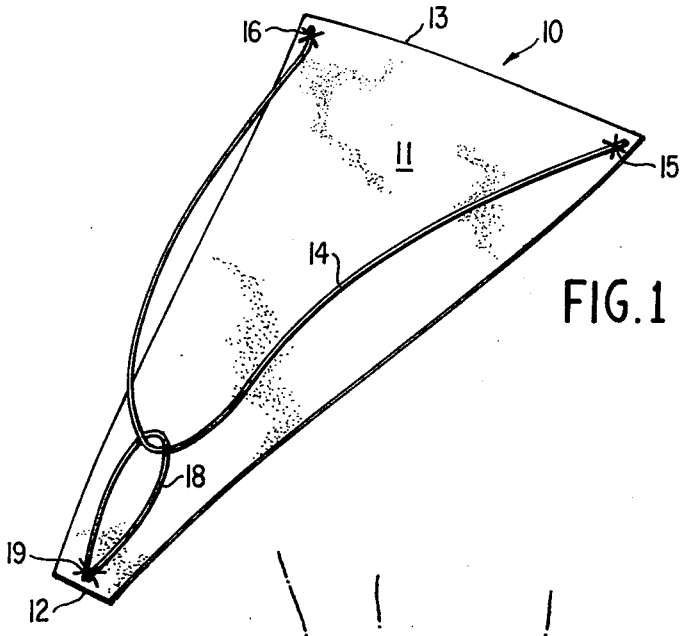
FIG. 1 is a top plan view of a first embodiment of the invention.

Referring now to FIG. 1, there is shown a panty 10 according to the instant invention which includes a triangular cloth crotch-piece 11 that is cut-off at the back-end 12. The front-end 13 of the crotch-piece 11 has a front loop formed by securing an elastic string 14 to each corner 15 and 16 by stitches, or the like. A rear loop 18 is interlocked with the front loop and is secured to the rear 12 of the crotch-piece by a stitch 19.

Figure 2:
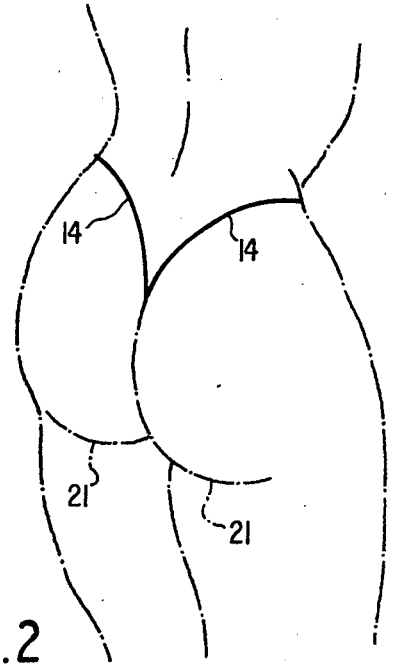
FIGS. 2 and 3 are front and rear views of the panty of FIG. 1, showing the panty being worn.
Figure 3:
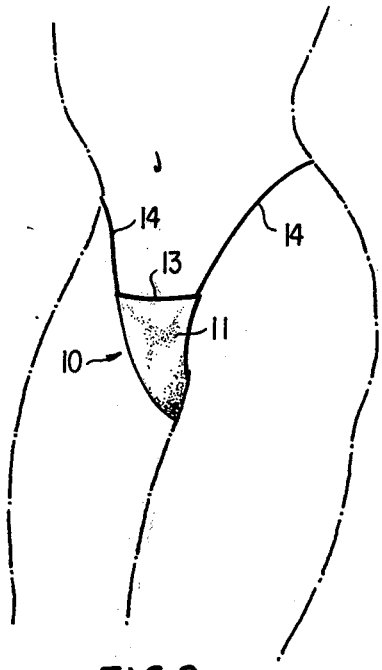

Referring now to FIGS. 2 and 3, it is seen that the crotch-piece 11 is visible from the front but is not visible from the back. This is because the rear loop 18 is disposed within the cleavage between the woman's buttocks while the crotch-piece 11 extends over the pubic area. It is readily seen from FIG. 2, that there is no panty structure that needs to be aligned with or which competes with the crease 21 that separates the woman's buttocks from her thighs. The loop formed by elastic string 14 extends over the woman's pelvis in order to hold the crotch-piece 11 in place. By fitting over the pelvis, the string 14 is, for all purposes, invisible through one's clothes. This is because clothes generally have a belt area, some sort of gathering or some other non-translucent structure around the waist. Furthermore, since the crotch-piece 11 is relatively small, light and is partially supported by the thighs, the elastic string 14 can be quite thin and need not press tightly against the flesh. Accordingly, the panty shown in FIGS. 1 through 3 is quite comfortable. It should be noted, that there is no elastic band which surrounds the thighs and there is no band which extends continuously around the waist. Instead, the strings 14 follow the natural contours of the body, and rest on the natural shelf created by the pelvic bone; and in the rear following natural body lines from the rear crease, across the small of the back and over the hips.

Figure 4:
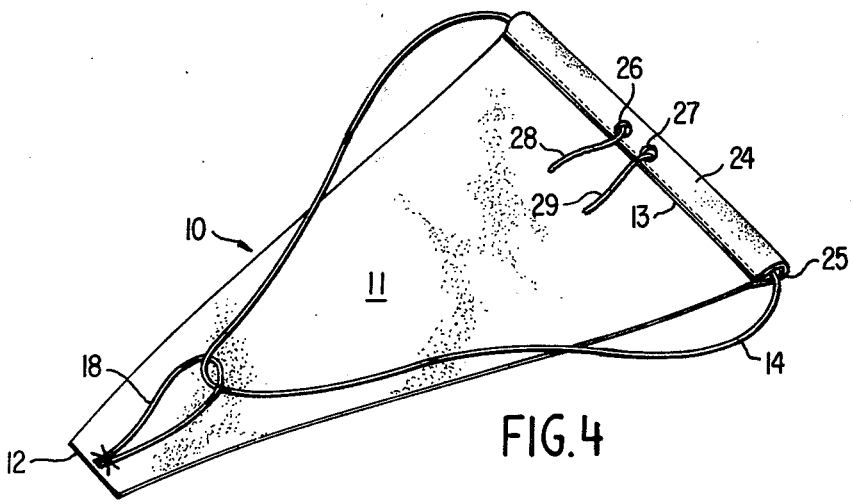
FIG. 4 is a plan view of a second embodiment of the type of panty shown in FIG. 1.

FIG. 4, is a modification of FIG. 3, in which the front edge 13 of the crotch-piece 11 is folded over to form a hem 24 that defines a tube 25, through which the string 14 of the front loop passes. The hem 24, includes two openings, 26 and 27 through which the ends 28 and 29 of the string 14 project, so that the string may be tied in place. In the embodiment of FIG. 4, the string 14 does not necessarily have to be elastic; it can be non-elastic or partially elastic. When the string is tied, the bow is on the inside of the crotch-piece 11, between the crotch-piece and the body and therefore is not visible. When worn, the embodiment of FIG. 4 appears, as shown in FIGS. 2 and 3.

Figure 5:
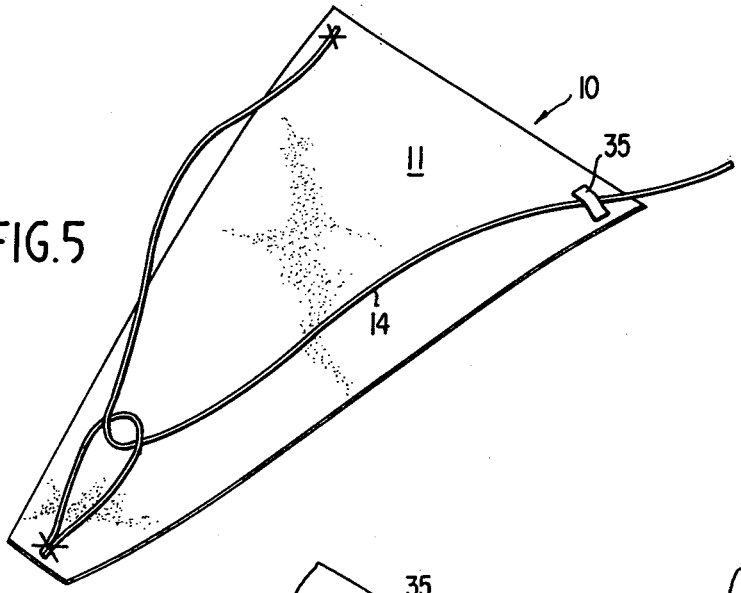
FIG. 5 is a third embodiment of the type of panty shown in FIG. 1.
Figure 5A:
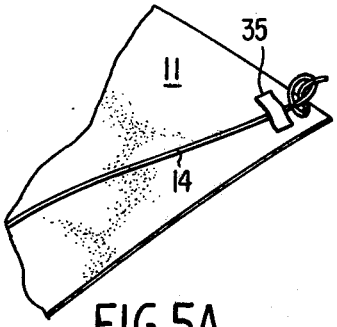
FIG. 5A is a view showing a knot used with the panty of FIG. 5.
Figure 5B:
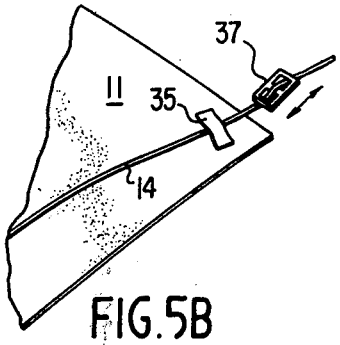
FIG. 5B is a view showing an adjustment clip used with the panty of FIG. 5.

A third alternative for the concept shown in FIG. 1 is shown in FIG. 5, where a loop 35 is tacked to one corner of the crotch-piece 11 so that the length of the string 14 can be adjusted by pulling it through the loop 35. The string 14 may be secured in the loop 35 by knotting or by tying the string, as shown in FIG. 5A. Alternatively, a sliding buckle 37 may be utilized, as shown in FIG. 5B. The sliding buckle is larger than the opening defined by the loop 35, so that the string 14 cannot slip back through the loop 35. In the embodiment of FIG. 5, the string 14 is preferably elastic.

Figure 6:
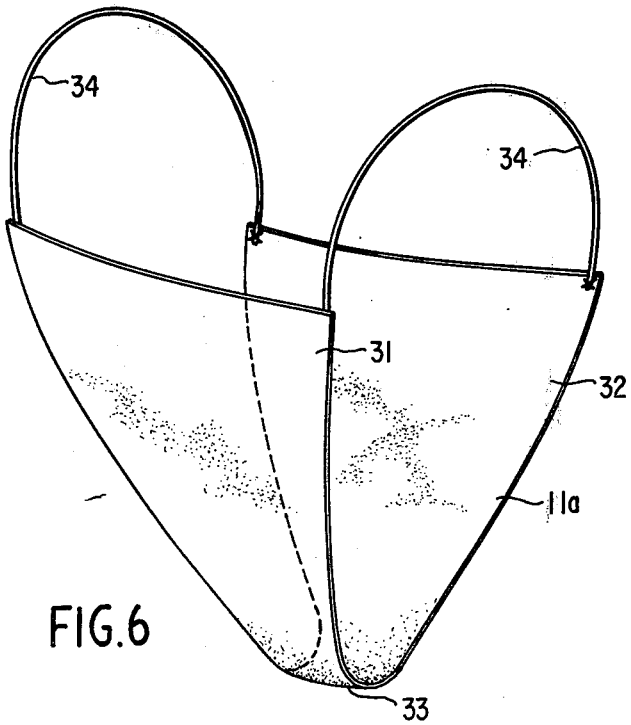
FIG. 6 is another embodiment of the panty, according to the instant invention.
Figure 7:
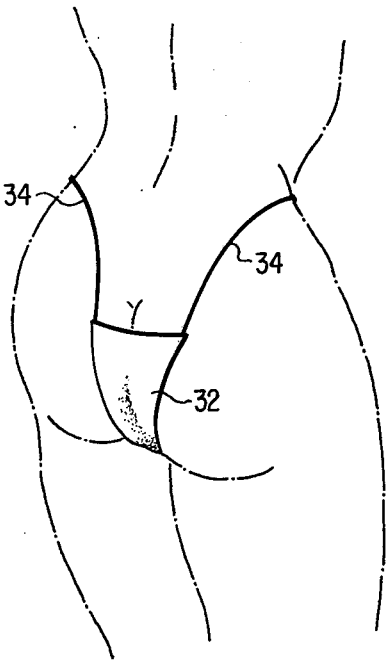
FIG. 7 is a rear view of the embodiment of the panty shown in FIG. 6.
Figure 8:
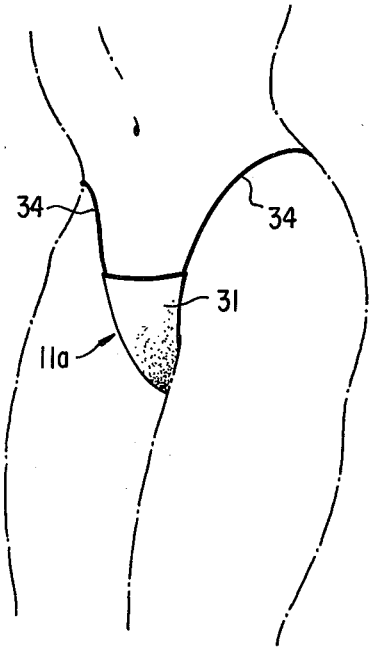
FIG. 8 is a front view of the embodiment of the panty shown in FIG. 6.

Referring now to the embodiment of FIGS. 6, 7 and 8, the crotch-piece 11A has a different configuration wherein there is a front panel 31 and a rear panel 32, which are generally triangular and are joined at the narrow area 33. The crotch-piece 11A is preferably made of a single piece. Attached to the crotch-piece 11A, are elastic strings 34 which are secured to the top corners of the front and rear panels 31 and 32. As seen in FIGS. 7 and 8, the strings 34 are worn above the pelvis to support the crotch-piece 11A. The basic difference between the embodiments shown in FIGS. 6, 7 and 8 and the embodiments shown in FIGS. 1 through 5, is that a rear triangular piece 32 is provided to fit over the cleavage between the buttocks. This may be desirable in some situations. Note however, that there is no elastic band which extends between the thighs and the buttocks, and only the thin elastic string 34 is necessary to hold the crotch-piece 11A in place.

Figure 6A:
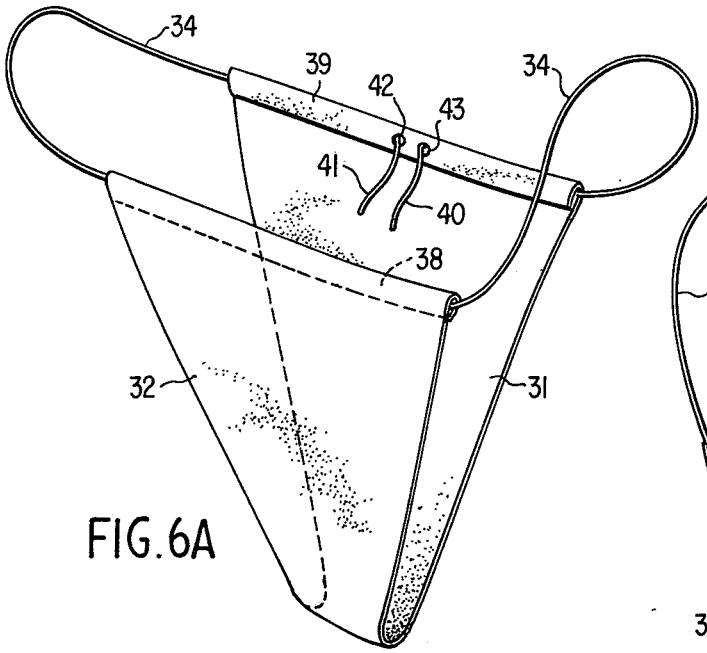
FIG. 6A is a first modification of the embodiment shown in FIG. 6.

FIG. 6A shows a second embodiment of the panty of FIG. 6 wherein the loops 34 are passed through a rear hem 38 and a front hem 39. The loops 34 have free ends 40 and 41 which project through openings 42 and 43 and the front hem 39, and are tied to provide the proper length and tension on the strings 34. In this embodiment, the strings 34 are preferably elastic but not necessarily elastic. By adjusting the length of the strings 34, the relative position between the front panel 31 and rear panel 32 may be adjusted to the position desired by the wearer.

Figure 6B:
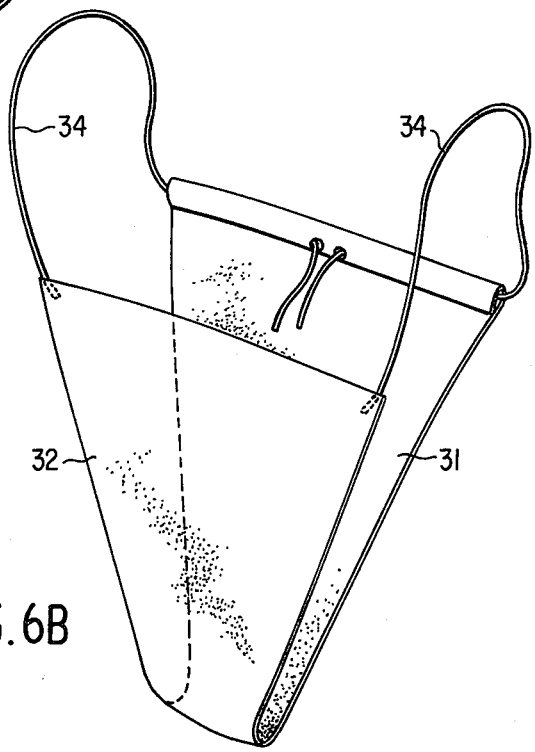
FIG. 6B is a second embodiment of the modification shown in FIG. 6.

In FIG. 6B, there is no rear hem 38 but rather the elastic strings 34 are simply sewed or otherwise permanently attached to the corners of the rear triangular panel 32. In both FIGS. 6A and 6B, the strings 34 are tied and the knot or bow remains inside the panties, so as to not be visible through the wearer's clothes or outside of the panty.

Figure 9A:
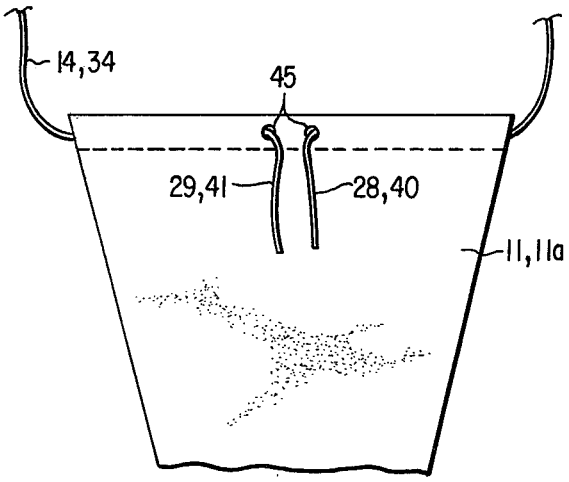
FIGS. 9A through 9F illustrate different ways of tensioning and adjusting the elastic strings, which are used to support the panty on the body.

Referring now to FIGS. 9A through 9F, there are shown several different embodiments for tying the strings 14 and 34, shown in FIGS. 1 through 8. In FIG. 9A, the ends of the strings 40,28 and 41,29 project through openings 45 in the front of the crotch-piece 11 or 11A, so that they may be tied in a bow at the front. The hem is folded over and faces rearwardly so that it is not visible, however, the bow is visible.

Figure 9B:
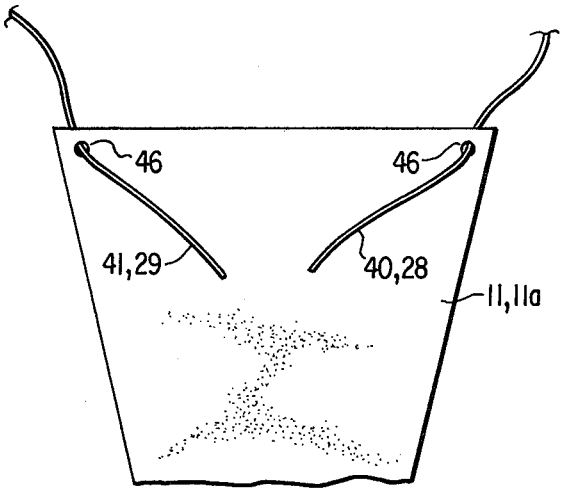
Figure 9C:
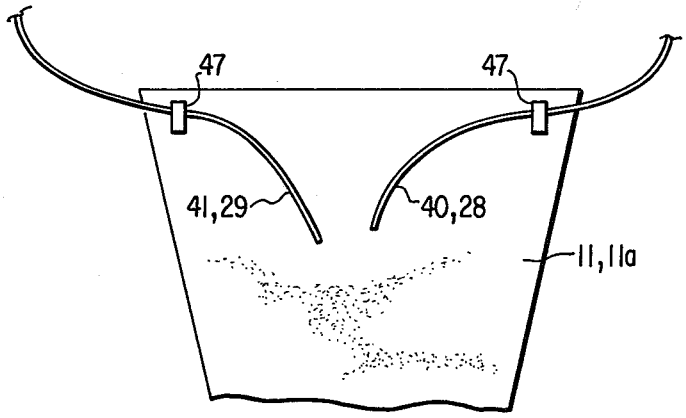

In the embodiment of FIG. 9B, the ends of the string 40,28 and 41-29 project through holes 46 in the front of the crotch-piece and are tied in the front, so as to be visible. Alternately, as seen in FIG. 9C the ends 40,28 and 41,29 pass through loops 47, secured to the front of the crotch-piece 11 and are tied in the front.

Figure 9D:
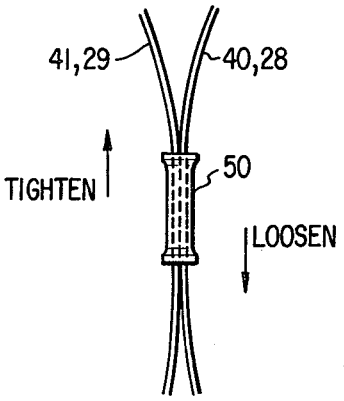

As seen in FIG. 9D, the strings 40,28 and 41,29 are passed through a tube 50 which tightly engaged the strings so that they will not slip. By pulling the strings downwardly, through the tube, the strings are tightened and by pulling the strings upwardly, through the tube, the strings are loosened.

Figure 9E:
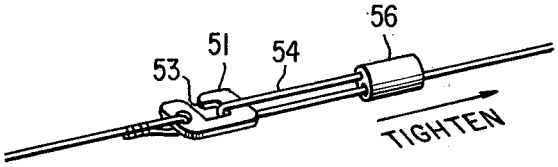
Figure 9F:
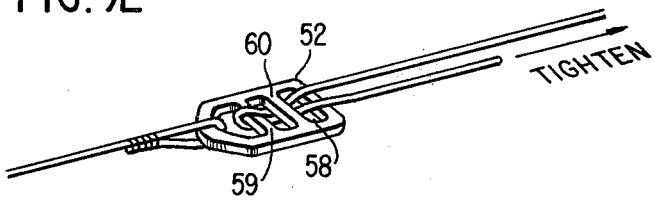

In FIGS. 9E and 9F, sliding clips 51 and 52 may be used to tighten the strings. In FIG. 9E the clip 51 has an open slot 53 therein, in which a loop 54 fits. The string may be tightened by moving a friction slide 56 to the right. In FIG. 9F, the clip 52 has a frame 58 which includes a first bar 59 around which the string is looped. Both the free end of the string and the attached end of the string, pass between a pair of bars 60 which serve as a friction catch. As the free end of the string is pulled, the friction catch 60 holds the string in the desired position.

While string is preferably elastic, it may also be partially elastic or non-elastic in all disclosed embodiments.

The foregoing examples and embodiments are merely descriptive of the invention, which to be limited only by the following appended claims.

What is claimed is:

1. A panty comprising:

a triangular shaped crotch-piece having parallel front and rear edges joined by sides which converge from the front edge to the rear edge to form a panel with four corners and four sides;

a first relatively thin string attached to the crotch-piece adjacent the corners of the front edge of the crotch-piece, and a second string of substantially smaller length than said first string having the free ends thereof attached adjacent one another to a single point adjacent the rear edge of the crotch-piece, said second string forming a loop through which said first projects wherein when the panty is worn the first string extends over the pelvis of the wearer and the second string extends along the cleavage between the buttocks of the wearer.

2. The panty of claim 1 wherein the strings are elastic.

3. The panty of claim 1 wherein one end of the first string is passed through a loop which is secured through the corner of the crotch-piece and wherein means are provided for preventing the first string from slipping back through the loop to increase the length of the first string.

4. The panty of claim 3 wherein the means for preventing slipping of the string is a buckle having a dimension larger than the opening of the loop.

5. The panty of claim 4 wherein the string is elastic.

6. The panty of claim 1 wherein the front edge of the crotch-piece is folded over to form a hem that provides a tube through which the free ends of the first string pass and which includes two openings adjacent the center thereof wherein the free ends of the string project through the openings so that the string may be tied.

7. A panty comprising:

a crotch-piece having triangular front and rear panels which converge toward one another to form a single panel with four corners and four sides and having a rear edge and a front edge which are parallel, a pair of strings wherein one string extends between the right corner of the front panel and right corner of the rear panel while the other string extends between the left corner of the front panel and right corner of the rear panel, and wherein the strings fit over the pelvis of the wearer in order to support the crotch-piece in place, and the front edge of the front panel is folded over to make a hem which defines the tube through which the free ends of the strings are pulled and wherein the tube has a pair of openings through which the free ends of the strings project so that the strings may be tied according to the adjustment desired by the wearer.

8. The panty of claim 7 wherein the hem is formed on the inside of the panty and wherein the strings are tied on the inside of the panty so that the tie is covered by the panty.

9. The panty of claim 7 wherein an adjustable clip means is used to tie the ends of the strings together.

10. The panty of claim 7 wherein the strings are elastic.

* * * * *